US006589606B2

(12) United States Patent
Waterkamp et al.

(10) Patent No.: US 6,589,606 B2
(45) Date of Patent: Jul. 8, 2003

(54) ELECTROSTATIC COATING OF MOLDINGS WITH THERMOPLASTIC AND CROSSLINKABLE COPOLYAMIDE HOT-MELT ADHESIVES

(75) Inventors: Paul-Ludwig Waterkamp, Recklinghausen (DE); Ulrich Simon, Herne (DE); Hans-Willi Losensky, Marl (DE)

(73) Assignee: Degussa AG, Duesseldorf (DE)

( * ) Notice: Subject to any disclaimer, the term of this patent is extended or adjusted under 35 U.S.C. 154(b) by 0 days.

(21) Appl. No.: 09/893,642

(22) Filed: Jun. 29, 2001

(65) Prior Publication Data

US 2002/0031614 A1 Mar. 14, 2002

(30) Foreign Application Priority Data

Jul. 1, 2000 (DE) ..... 100 32 075

(51) Int. Cl.[7] ..... B05D 1/04

(52) U.S. Cl. ..... 427/458; 427/475; 427/485; 427/208.2

(58) Field of Search ..... 427/458–461, 427/475–482, 485–486, 208.2, 133, 135; 361/227; 525/420.5, 424

(56) References Cited

U.S. PATENT DOCUMENTS 6,114,489 A * 9/2000 Vicari et al.
6,127,513 A * 10/2000 Ohara et al.

* cited by examiner

*Primary Examiner*—Fred J. Parker
(74) *Attorney, Agent, or Firm*—Oblon, Spivak, McClelland, Maier & Neustadt, P.C.

(57) ABSTRACT

A process is described in which a nonconductive molding is electrostatically coated with a thermoplastic or crosslinkable copolyamide hot-melt adhesive. The hot-melt adhesive may be used as a fine powder with a particle size between 1 and 200 $\mu$m and have a melting point up to 160° C.

16 Claims, No Drawings

ELECTROSTATIC COATING OF MOLDINGS WITH THERMOPLASTIC AND CROSSLINKABLE COPOLYAMIDE HOT-MELT ADHESIVES

BACKGROUND OF THE INVENTION

The present invention is directed to an electrostatic coating of moldings with a thermoplastic, and crosslinkable copolyamide hot-melt adhesives.

DISCUSSION OF THE BACKGROUND

At present, a very wide variety of moldings (e.g., parcel shelves, door side linings, roofliners) are based on phenolic-resin-consolidated cotton fiber residues or melamine-resin-consolidated wood chips which are laminated with a very wide variety of decorative materials based on polypropylene or polyesters. PU dispersions, moisture-crosslinking polyurethanes, or copolyamide hot-melt adhesives are used in the form of coarse powders (from 200 to 500 μm).

All of the systems used are hampered by disadvantages:

PU dispersions are applied using computer-controlled nozzles. The dispersion adhesives require long ventilation times until the water has evaporated, i.e., long cycle times are needed. Because of tackiness, the coated parts cannot be stored. During spraying, overspray is produced, which is lost and contaminates the plant. The cleaning effort is large. The advantage of this application is that it is possible to apply more adhesive deliberately at critical points (recesses) where a higher proportion of adhesive is needed.

The moisture-crosslinking PU adhesives are applied from the melt using nozzles; the plants must be protected against moisture (risk of crosslinking). Here again, overspray is produced, with the aforementioned disadvantages. In certain regions, the hot-melt adhesive may likewise be applied with higher weights. The heat stability is very high because of the crosslinking. The sprayed parts must be laminated immediately, since adhesive cures with atmospheric humidity and can then no longer be activated.

Thermoplastic copolyamides are used in the form of scatter powders with particle sizes from 200 to 500 μm. It is necessary to operate in two steps. First, the decorative material is coated using a scatter unit. In a second step, the hot-melt adhesive and the molding are activated or preheated by infrared, after which lamination is carried out in a cold press. The problem is that coarse powders are of only limited availability, since normally a heat stability of from 120 to 140° C. is required. Since, however, large amounts of fine powder between 1 and 200 μm are also obtained during the milling process, but are not suitable for linings owing to the high melting point of from 140 to 160° C., large amounts of powders are obtained which cannot be commercialized. A further disadvantage is that only a two-dimensional application weight can be set and there is no possibility of applying larger amounts locally.

It was an object of the invention to provide a process which does not have the disadvantages recited. Surprisingly, this object has been achieved by a process for coating comprising electrostatically coating a nonconductive molding with a thermoplastic or crosslinkable copolyamide hot-melt adhesive electrostatically.

SUMMARY OF THE INVENTION

Surprisingly, this object has been achieved by a process for coating comprising electrostatically coating a nonconductive molding with a thermoplastic or crosslinkable copolyamide hot-melt adhesive.

DETAILED DESCRIPTION OF THE PREFERRED EMBODIMENTS

The process of the invention permits the use of fine powders between 1 and 200 μm and features a heat stability of from 130 to 150° C. The copolyamide hot-melt adhesives used are alternatively thermoplastic or crosslinkable. The process permits the application, if desired, of different amounts to one substrate part; and it also renders crosslinkable coatings storable.

The thermoplastic hot-melt adhesives may be commercially customary copolyamides based on laurolactam, caprolactam, dicarboxylic acids with $C_5$ to $C_{12}$ chains and diamines with $C_5$ to $C_{10}$ chains. Common melting points are between 120 and 140° C. Even for the crosslinkable copolyamides, the same monomer bases are used; reactions with blocked isocyanates may be enabled by modifying the end groups. Following crosslinking, the heat stability is greatly improved (130 to 150° C.). The blocked isocyanate is ground and the particle fraction 1–50 μm is admixed with the copolyamide. The preferred particle size of the mixture is 1–80 μm.

Coating Techniques

As known from powder coatings, metals may be powder-coated with electrostatic powders using corona guns or turboelectricity guns. The powders are provided with an electronic charge, using high voltage or by means of friction, and are sprayed against an earthed metal, the powder depositing on the metal surface and adhering to the metal until, by means of heat, it has melted.

It has now surprisingly been found that even nonconductive substrates, such as phenolic-resin-consolidated cotton fibers, may be coated electrostatically.

By means of electrostatic gun application, particular regions requiring a greater level of application may be charged with larger amounts of powder, especially in the area of recesses, by way of computer control.

Since this kind of application operates with particle distributions from 1–200 μm, preferably 1–80 μm, it is possible to produce, specifically, powder fractions where there is no unavoidable by-product; consequently, it is possible to use even thermoplastic copolyamides having melting points of up to 160° C., as a result of which thermal stabilities of more than 130° C. may be achieved.

In the case of even higher requirements, e.g., 200° C., it is possible to coat crosslinkable copolyamides in this way. These polyamides contain amine-terminated end groups which are able to react with polyisocyanates or epoxides or combinations of both. The compounds in question are dimerized or trimerized polyisocyanate adducts from Degussa Hüls AG, under the designation VESTAGON®, which release the isocyanate only above a certain temperature (150° C.). Below this temperature, the copolyamides used may be treated like thermoplastic hot-melt adhesives and applied electrostatically; a preferred particle distribution is 1–200 μm, especially 1–80 μm. The release of the isocyanate initiates the crosslinking reaction and thus greatly improves the heat stability.

Since powder coating is carried out at below the crosslinking temperature, the powder is melted at approximately 140° C. It is now possible to cool the precoated molding or to laminate it directly with the decorative material. Crosslinking may be carried out by a subsequent heat treatment at a temperature above 150° C. for a period of a few minutes. In other words, a molding coated with a crosslinkable copolyamide may also be stored, which is not possible with the conventional systems.

Having generally described this invention, a further understanding can be obtained by reference to certain specific examples which are provided herein for purposes of illustration only and are not intended to be limiting unless otherwise specified.

EXAMPLE

Parcel Shelves and Automobile Roofliners

In the automotive supply industry, needle-punched nonwovens and knits are laminated to a very wide variety of supports (textile residues cured with phenolic resin, wood chipboards, jute fibers) by means of scattered copolyamide hot-melt adhesives.

Using thermoplastic copolyamides, a maximum heat stability of 125° C. is attained.

By means of the post-crosslinkable hot-melt adhesive, it is possible to achieve a heat stability of from 130 to 200° C. After the hot-melt adhesive has been applied in the thermoplastic temperature range, post-crosslinking may be carried out using a heatable press with a temperature above 140° C. for a time of 2 minutes. It is also possible to post-crosslink the finished parcel shelf or roofliner in an oven at a temperature above 145° C. for 2 minutes.

This application is based on German patent application 10032075.9 filed in the German Patent Office on Jul. 1, 2000, the entire contents of which are hereby incorporated by reference.

What is claimed is:

1. A process comprising electrostatically coating a nonconductive molding with a powder comprising a crosslinkable copolyamide hot-melt adhesive.

2. The process of claim 1, comprising applying said coating by means of an electrostatic gun.

3. The process of claim 1, wherein said crosslinkable copolyamide hot-melt adhesive comprises a fine powder with a particle size between 1 and 200 $\mu$m.

4. The process of claim 1, wherein said crosslinkable copolyamide has a melting point of up to 1400° C.

5. The process of claim 1, further comprising heating to crosslink said crosslinkable copolyamide hot-melt adhesive.

6. The process of claim 1, wherein said crosslinkable copolyamide hot-melt adhesive comprises a component selected from the group consisting of laurolactam, caprolactam, dicarboxylic acids with $C_{5-12}$ chains and a diamine component with $C_{5-10}$ chains.

7. The process of claim 1, wherein said nonconducting molding comprises phenolic resin consolidated cotton fibers.

8. The process of claim 1, wherein said crosslinkable copolyamide hot-melt adhesive comprises a fine powder with a particle size between 1–80 $\mu$m.

9. The process of claim 1, further comprising storing said nonconducting molding coated with said crosslinkable copolyamide hot-melt adhesive for a period of time uncrosslinked.

10. The process of claim 1, wherein different regions of said nonconductive molding comprise different amounts of said crosslinkable copolyamide hot-melt adhesive.

11. The process of claim 1, wherein said nonconductive molding comprises melamine resin consolidated wood chips.

12. The process of claim 1, wherein said crosslinkable copolyamide hot-melt adhesive has a heat stability of from 130 to 2000° C.

13. A process comprising electrostatically coating a nonconductive molding with a powder comprising a crosslinkable copolyamide hot-melt adhesive, wherein said crosslinkable copolyamide comprises a copolyamide and a blocked isocyanate.

14. The process of claim 13, wherein said blocked isocyanate is a dimerized or trimerized polyisocyanate adduct which releases isocyanate above 150° C.

15. The process comprising electrostatically coating a nonconductive molding with a powder comprising a crosslinkable copolyamide hot-melt adhesive, wherein said crosslinkable copolyamide hot-melt adhesive consists essentially of a crosslinkable copolyamide and a blocked isocyanate.

16. The process of claim 15, wherein said blocked isocyanate is a dimerized or trimerized polyisocyanate adduct which releases isocyanate above 150° C.

* * * * *